US007189057B2

(12) United States Patent
Lee et al.

(10) Patent No.: US 7,189,057 B2
(45) Date of Patent: Mar. 13, 2007

(54) TURBINE SHROUD SEGMENT ATTACHMENT

(75) Inventors: Stuart Lee, Berlin (DE); Harald Schiebold, Berlin (DE)

(73) Assignee: Rolls-Royce Deurschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 10/681,329

(22) Filed: Oct. 9, 2003

(65) Prior Publication Data

US 2004/0115043 A1 Jun. 17, 2004

(30) Foreign Application Priority Data

Oct. 10, 2002 (DE) ..... 102 47 355

(51) Int. Cl.
*F01D 25/26* (2006.01)

(52) U.S. Cl. ..... 415/136; 415/128; 415/139; 415/173.3

(58) Field of Classification Search ..... 415/136, 415/137, 139, 173.3, 127, 128, 174.2; 416/191
See application file for complete search history.

(56) References Cited

U.S. PATENT DOCUMENTS 2,634,090 A 4/1953 Hardigg
4,439,981 A * 4/1984 Weiler et al. ..... 415/136
4,863,345 A 9/1989 Thompson et al.
5,228,828 A * 7/1993 Damlis et al. ..... 415/173.2
5,456,576 A * 10/1995 Lyon ..... 415/173.3
6,406,256 B1 6/2002 Marx

FOREIGN PATENT DOCUMENTS

| | | |
|---|---|---|
| DE | 1426857 | 12/1968 |
| DE | 3818882 | 1/1989 |
| EP | 0381895 | 8/1990 |

OTHER PUBLICATIONS

German Search Report dated Jan. 10, 2003.

* cited by examiner

*Primary Examiner*—Edward K. Look
*Assistant Examiner*—Igor Kershteyn
(74) *Attorney, Agent, or Firm*—Harbin King & Klima

(57) ABSTRACT

A turbine shroud segment attachment with a casing (1) and several shroud segments (2) arranged in the casing (1), wherein the individual shroud segments (2) are located in the casing (1) with a circumferential clearance (3) between the individual shroud segments (2), in that the clearance (3) is reduced to zero at a given temperature difference between the casing (1) and the shroud segments (2), and in that the shroud segments (2) are retained on the casing (1) by way of an elastically deformable locating arrangement.

26 Claims, 4 Drawing Sheets

TURBINE SHROUD SEGMENT ATTACHMENT

This application claims priority to German Patent Application DE 10247355.2 filed Oct. 10, 2002, the entirety of which is incorporated by reference herein.

BACKGROUND OF THE INVENTION

This invention relates to a turbine shroud segment attachment with a casing and several shroud segments arranged in the casing.

The use of shroud segments for sealing the gap at the tip of a rotor blade is known from the prior art. It is also known that the gap between the tip of the rotor blade and the shroud varies with the thermal expansion or contraction of both the rotor blade and the casing. An excessively large gap leads to flow losses, while an excessively small gap may cause mechanical damage.

Normally, the individual shroud segments are located loosely on the casing with appropriate clearance, with the clearance in the axial and circumferential direction being dimensioned such that it is irrelevant for the control of the running gap if the shroud segments expand under the influence of temperature. This arrangement provides that the radial location in the casing and, consequently, the radial gap to the rotor blade is largely independent of the temperature of the shroud segments.

Various solutions were proposed for the control of the gap between the tip of the rotor blade and the respective shroud segment. Specification U.S. Pat No. 4,657,479, for example, shows a mechanical solution with an active system in which the relative position of the shroud segment to the outer casing is variable. Control is effected by a multitude of bolts arranged between the shroud segments. The bolts are rotated by means of an actuating mechanism, separating the shroud segments from each other. This increases the entire circumferential length of the shroud composed of the individual shroud segments, resulting in a radial outward movement relative to the casing. Thus, the gap to the rotor blade tip is increased. Movement in the opposite direction is effected by spring-type elements.

This mechanism involves considerable complexity and manufacturing costs and is highly susceptible to malfunction. A further disadvantage is the need for an external control system.

A gap sealing arrangement is known from Specification DE 14 26 857 A1 in which the individual shroud segments engage each other on their circumferential sides in a labyrinth-type manner. This provides for a relatively large freedom of movement of the shroud segments, allowing the shroud segments to move freely during thermal contraction or expansion.

Specification DE 38 18 882 C2 describes a gas-turbine engine provided with shroud segments of chamfered design compensating for thermal contraction or expansion.

A further design is shown in Specification EP 0 381 895 A1. Here, the shroud is located with a radial gap allowing it to move radially and expand or contract under thermal influence.

BRIEF SUMMARY OF THE INVENTION

In a broad aspect, the present invention provides a turbine shroud segment attachment which, while being of simple design and function, ensures reliable gap control even under extreme operating conditions.

It is a particular object of the present invention to provide a solution to said problems by the combination of the features described below, with further objects and advantages of the present invention becoming apparent from the present descriptions.

Accordingly, the present invention provides for the individual shroud segments to be located in the casing with clearance in the circumferential direction, that the clearance between the casing and the shroud segments is reduced to zero at a given temperature difference, and that the shroud segments are retained on the casing by means of an elastically deformable locating arrangement.

The turbine shroud segment attachment according to the present invention is characterized by a variety of merits.

In accordance with the present invention, the shroud segments are arranged such that the radial movement of the shroud segments will be in agreement with the expansion of the rotor blades, thus enabling the clearance at the rotor blade tips to be controlled.

The present invention is particularly favourable if the temperature differences between the casing (cold casing) and the rotor (high temperature of the rotor disks) are very large. While the location of the shroud segments, owing to the clearance provided, will allow them to expand or contract thermally in normal operation, the occurrence of a large temperature difference as mentioned above will eliminate the clearance defined by the present invention, causing the individual shroud segments to clamp to the casing. In the process, the individual shroud segments are clamped together to form one ring which, in terms of its degree of expansion and its thermal expansion characteristics, behaves like a single component. The elastically deformable locating arrangement according to the present invention allows for further thermal expansion of the now clamped shroud segments, while the initial large temperature difference is applied to eliminate the clearance. Thus, the clearance will be closed more quickly, avoiding contact of the tips of the rotor blades.

In accordance with the present invention, it can be favourable to provide the clearance of the shroud segments in the circumferential direction. In an alternative form of the present invention, the clearance can also be provided in the axial direction in the locating area of the shroud segments. If clearance in the circumferential direction is provided, the individual shroud segments will, by thermal expansion, close to form a single, continuous ring which, with further thermal expansion, will behave like a single component. As regards its radial diametrical change, the behavior of such a single, continuous ring of shroud segment elements will accordingly depend on the thermal expansion characteristics of the casing. If clearance in the axial direction is provided, the individual shroud segments will each be clamped individually against the casing. In this case, they will again form a unit with the casing and, with further heating, expand in agreement with the thermal reaction of the casing or contract; the applicable kinematics being achieved by suitable design of the flexible locating arrangement.

All these features result in an enhanced, fully automatic control of the clearance at the tips of the rotor blades. External actuating devices can be fully dispensed with.

In the case of the variant with axial clamping, the "soft" location of the individual shroud segments in accordance with the present invention is preferably accomplished by essentially T-shaped locating elements. Accordingly, the locating elements, in the cross-section, feature sideward arms with defined inclination and stiffness by which the shroud segments rest against the casing or are retained on the casing, respectively. The elastic deformability of these arms, in combination with an appropriate location on the casing, allows the shroud segments to move relative to the casing and effect the intended radial movement when clamped.

Therefore, in accordance with the present invention, the clearance provided allows the shroud segments to move relatively freely in the cold condition, while they are clamped with the casing above a defined temperature difference by the effect of thermal expansion.

BRIEF DESCRIPTION OF THE DRAWINGS

This invention is more fully described in the light of the accompanying drawing showing preferred embodiments. In the drawings.

DETAILED DESCRIPTION OF THE INVENTION

The detailed description below should be read in conjunction with the summary of the invention above.

Figure 1:
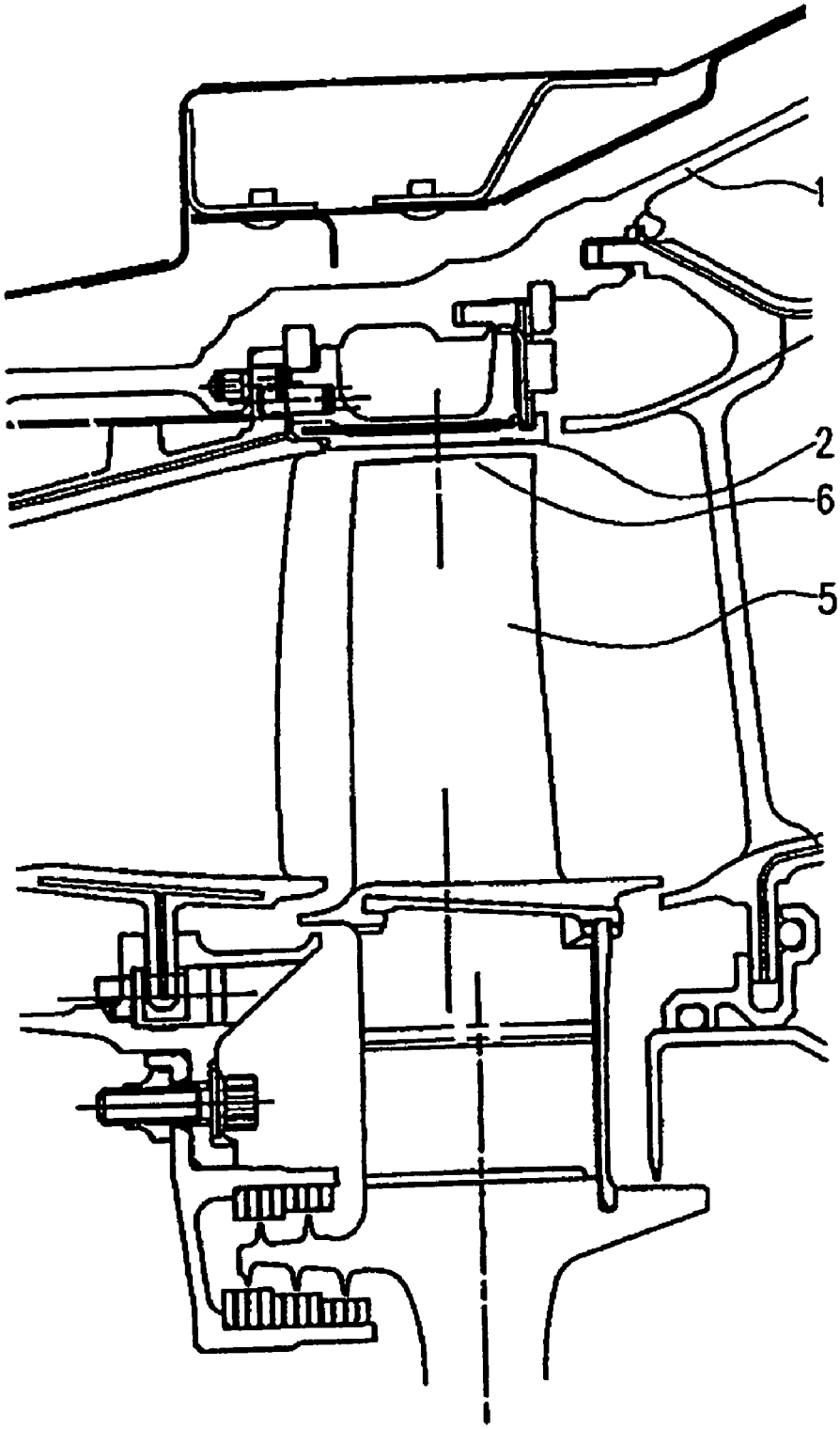
FIG. 1 is a schematic representation of the relationship of a rotor blade and a shroud segment in the casing of a turbine stage.

FIG. 1 shows a partial area of a turbine stage with a rotor blade 5 attached to a disk. The tip 6 of the rotor blade passes a gap along several shroud segments 2 which form a ring, as becomes apparent from FIG. 4, for example. The shroud segments 2 are located on a casing 1 in a manner still to be described.

Figure 2:
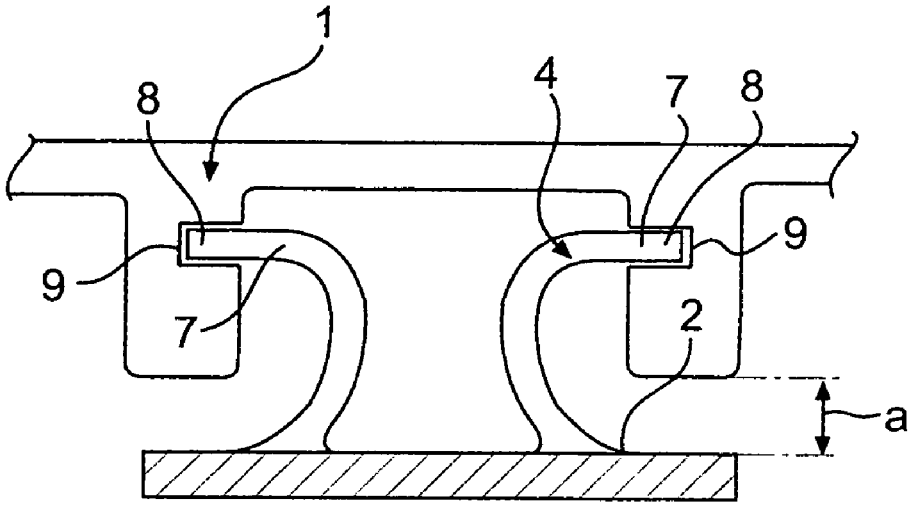
FIG. 2 is an enlarged detail view of a first embodiment of the present invention with an elastically deformable locating arrangement.

FIG. 2 shows one design of locating elements 4 for the retention of the shroud segments 2 on the casing 1. In one embodiment, the locating arms 7 are essentially elastically deformable. They are held in grooves 9 of the casing 1 by means of protrusions 8. This arrangement provides for radially outward movement of the shroud segments 2.

Figure 4:
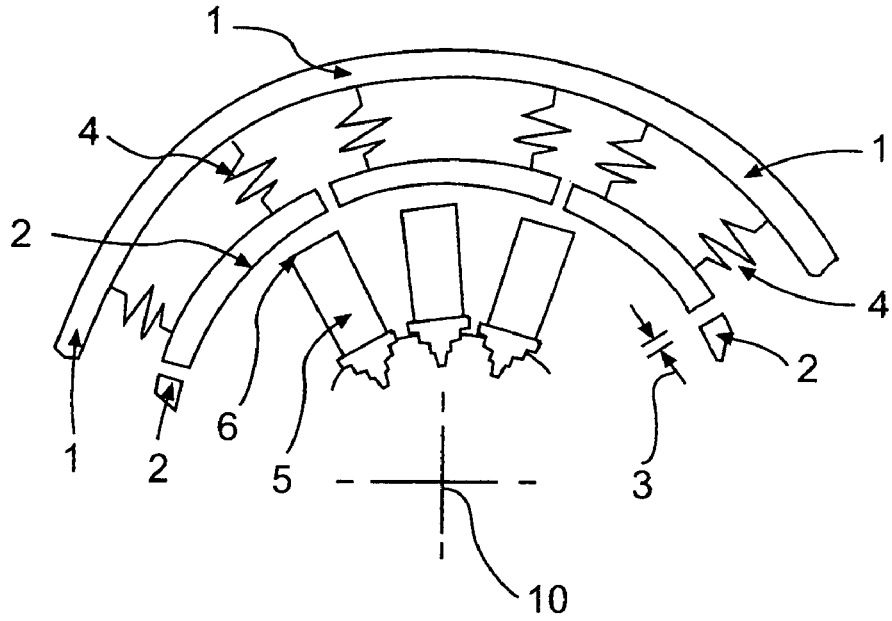
FIG. 4 is an axial partial view of a design according to the present invention in a stationary operating state.
Figure 5:
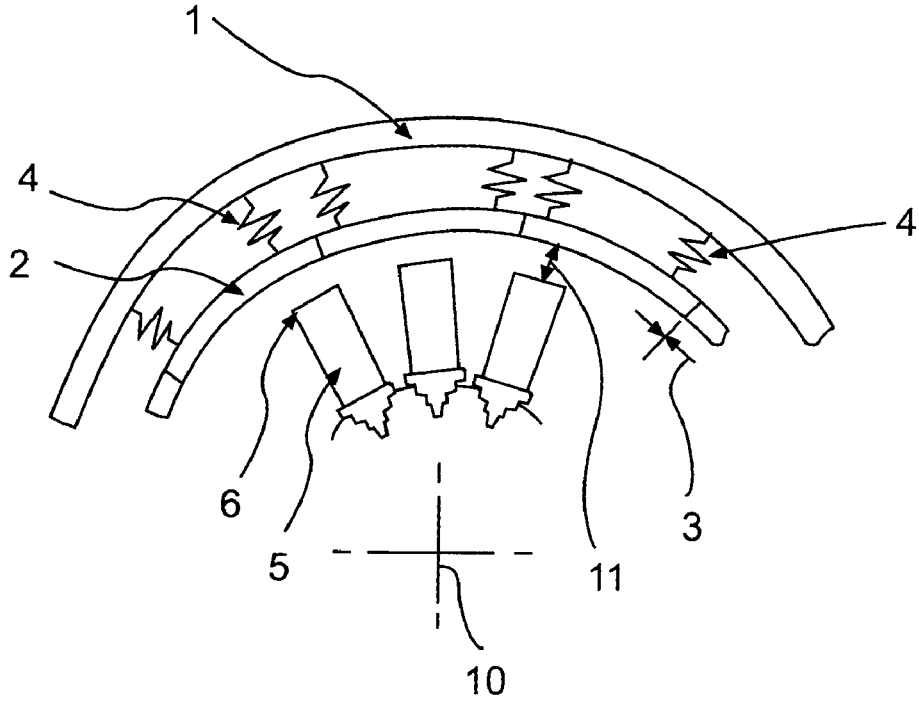
FIG. 5 is a view, analogically to FIG. 4, in a transient operating state.

FIG. 4 and 5 present two views of a section normal to the center axis 10 of the gas turbine. Here, the individual shroud segments 2 and their elastic locating elements 4, in particular, become clearly apparent. FIG. 4 shows a stationary operating state in which a clearance 3 in the circumferential direction exists between the individual shroud segments. The casing 1 has a pre-defined stiffness. The same applies to the locating elements 4. Similarly, the shroud segments 2 have a pre-defined strength and stiffness. Both the casing 1 and the shroud segments 2 feature a pre-defined thermal expansion or contraction behavior, which results in the gap 3 (clearance).

FIG. 5 shows a transient operating state in which a radial gap 11 between the tips 6 of the rotor blades 5 is larger than in the case of the stationary operating state shown in FIG. 4, for example. The circumferential spacing of the shroud segments 2 is eliminated by their thermal expansion, so that no clearance exists. Accordingly, the shroud segments 2 form a firm, continuous ring. Further thermal expansion will result in an outward radial movement of this ring, enabled by the elasticity of the locating elements 4.

The broken lines indicate the movability of the shroud segments 2 in the radial outward direction under further thermal impact. The "soft" location provided by the locating elements 4 accordingly allows the shroud segments to move radially outwards, thus reacting to the heating of the rotor blades 5 and maintaining the appropriate tip clearance.

Figure 3:
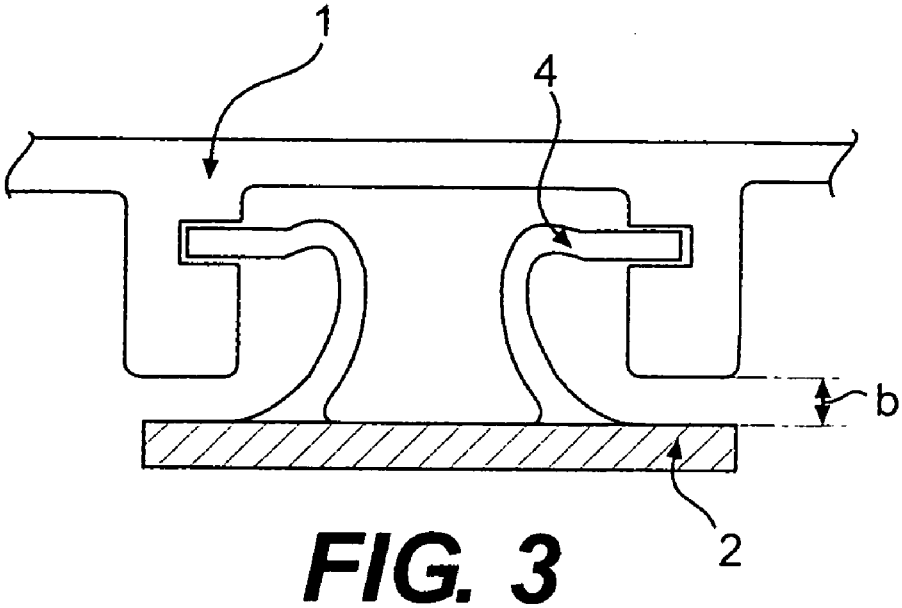
FIG. 3 is a view, analogically to FIG. 2, in a second temperature state.

FIGS. 2 and 3 show an embodiment for the provision of the clearance 3 according to the present invention. FIG. 2 corresponds to the state of FIG. 4. A distance or gap "a"here results between the shroud segments 2 and the casing 1. A temperature state exists to which the following equation applies:

$$T_{shroud\ segment}-T_{casing}\leq\Delta T_{critical}$$

FIG. 3 shows an operating state according to FIG. 5. In this case, the shroud segments 2 abut on each other. A gap "b" here results between the shroud segments 2 and the casing 1 which is smaller than the gap "a" shown in FIG. 2. A thermal state exists in FIG. 3 which can be expressed as follows:

$$T_{shroud\ segment}-T_{casing}>\Delta T_{critical}$$

The present invention accordingly enables the gap between the tips 6 of the rotor blades 5 and the shroud segments 2 to be automatically controlled in the desired manner, without the need for additional, external measures. The present invention is, therefore, based on the principle that the shroud segments, as well as the rotor blades, expand or contract thermally more or less at the same time and with the same expansion rate. The shroud segments are temporarily lifted up in the radial direction by thermal expansion, thus avoiding contact with the tips 6 of the rotor blades 5 (see FIG. 5, for example). This temporary lifting-up of the shroud segments 2 is effected by appropriate dimensioning of the gap or clearance 3, with this gap or clearance closing in a pre-defined thermal situation.

Accordingly, the width of the clearance 3 varies with the temperature difference between the shroud segments 2 and the casing 1 or, respectively, the locating ring or locating area on which the shroud segments 2 are retained. During the critical transient operating state, the shroud segments 2 will then get clamped with each other in the circumferential direction and form a closed ring whose diameter will change with further thermal expansion.

Figure 6:
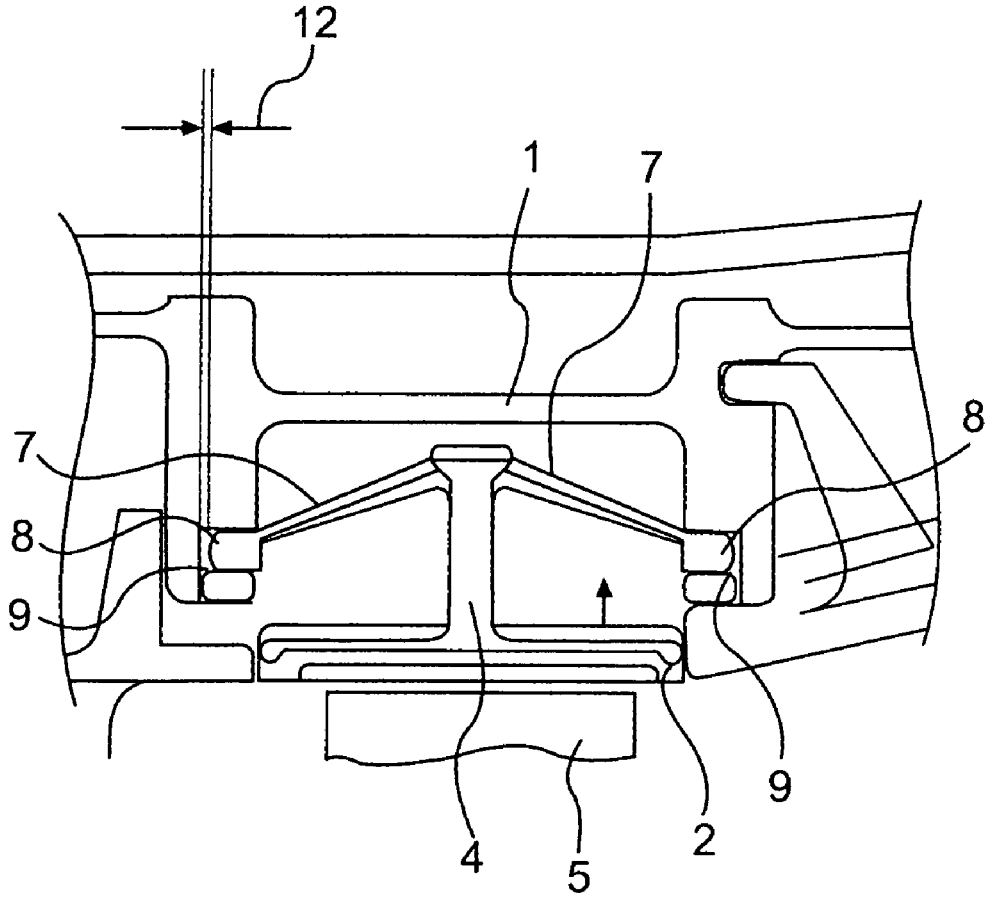
FIG. 6 is a design form with axial clearance.

FIG. 6 shows a modified design in which the protrusions 8 of the shroud segments 2 are retained in the groove 9 by retainers 13. A clearance in the axial direction is provided by way of an axial gap 12 between the shroud segment 2 and the casing 1. Heating of the shroud segments 2, after corresponding thermal expansion, will here as well produce the clamping effect in the casing 1. That is, once the axial gap 12 is eliminated by thermal expansion, further thermal expansion of the arms 7 is limited by the clamping effect in the axial and radially downward directions, and thus, is directed radially outward. This moves the shroud segments 2 radially outward.

Obviously, the present invention also provides for further freedom or a further clearance 12, for example, in an axial direction, to influence the thermal expansion characteristics of the shroud segments in other operating states. Furthermore, the individual gaps or clearances can be dimensioned differently in order to realize different characteristics of the individual components. Accordingly, the gaps may also be orientated differently to ensure that the shroud segments are clamped, with at least one component existing in the circumferential or in the radial direction. Therefore, in accordance with the present invention, at least one of the components must be present. This means that the clearance must exist in either the circumferential direction or the axial direction. Accordingly, the width of a radial gap 11 between the shroud segments 2 and the tips 6 of the rotor blades 5 is set by 1) the clearance 3 and/or the elasticity of the locating elements 4 which retain the shroud segments 2 on the casing 1 and/or 2) the clearance 12.

A plurality of modifications may be made to the embodiments here shown without departing from the inventive concept. Different aspects of the various embodiments can be combined different manners to create new embodiments.

What is claimed is:

1. A turbine shroud segment attachment with a casing and several shroud segments arranged in the casing, wherein the individual shroud segments are located in the casing with a circumferential clearance between adjacent individual shroud segments, the clearance being reduced to zero at a given temperature difference between the casing and the shroud segments, and the shroud segments being retained on the casing by way of an elastically deformable locating arrangement, wherein an axial clearance is provided between the casing and the locating arrangement, the locating arrangement comprising locating elements, each locating element being formed as a single component with a respective shroud segment such that each shroud segment includes at least one locating element.

2. A turbine shroud segment attachment in accordance with claim 1, wherein the locating elements are of essentially T-shaped cross-section with specifically inclined and shaped sideward arms.

3. A turbine shroud segment attachment in accordance with claim 1, wherein a width of a radial gap between the shroud segments and tips of rotor blades is set by at least one of the clearance and an elasticity of the locating elements which retain the shroud segments on the casing.

4. A turbine, comprising;

a casing;

a plurality of shroud segments positioned circumferentially adjacent each other around an interior of the casing;

a plurality of locating elements for retaining the shroud segments to the casing;

wherein, a clearance is provided between each shroud segment and at least one of the casing and an adjacent shroud segment and elimination of the clearance by thermal expansion of the components of the turbine fixably clamps a portion of each shroud segment with respect to at least one of the casing and an adjacent shroud segment such that further thermal expansion of the shroud segment moves a portion of the shroud segment positioned adjacent a turbine blade path radially outward, and comprising an axial clearance between each shroud segment and the casing, and wherein, upon elimination of the axial clearance between each shroud segment and the casing, a portion of each shroud segment is clamped with respect to the casing.

5. A turbine as in claim 4, wherein the clearance is a circumferential clearance positioned between adjacent shroud segments.

6. A turbine as in claim 5, wherein the locating elements are elastically deformable and can resist radially outward movement of the portions of the shroud segments adjacent the turbine blade path, and, upon elimination of the circumferential clearances between all of the shroud segments, the shroud segments are clamped together as a ring and maintained as a ring by the resistance provided by the elastically deformable locating elements.

7. A turbine as in claim 6, wherein the locating elements are integral with the shroud segments such that each shroud segment includes at least one locating element.

8. A turbine as in claim 6, wherein the locating elements are integral with the shroud segments such that each shroud segment includes at least one locating element.

9. A turbine as in claim 8, wherein the casing includes at least one groove and a portion of the locating element is positioned in the groove.

10. A turbine as in claim 6, wherein the clearance is reduced to zero at a given temperature difference between the casing and the shroud segments.

11. A turbine as in claim 4, wherein the locating elements are integral with the shroud segments such that each shroud segment includes at least one locating element and the portion of the shroud segment clamped with respect to the casing is the locating element.

12. A turbine as in claim 11, wherein the casing includes at least one groove and a portion of the locating element is positioned in the groove such that the axial clearance is located between a portion of the groove and a portion of the locating element.

13. A turbine as in claim 12, wherein each locating element has a central member and two cross arms extending radially inwardly and axially outwardly from a radially outward portion of the central member and outward portions of the cross arms are the portion of the locating element positioned in the groove.

14. A turbine as in claim 13, wherein, upon elimination of the clearance between the cross arms and the groove and the clamping of the cross arms to the casing, further thermal expansion of the cross arms in a radially inward and axially outward direction is substantially prevented.

15. A turbine as in claim 14, wherein the clearance is reduced to zero at a given temperature difference between the casing and the shroud segments.

16. A turbine as in claim 4, wherein the clearance is reduced to zero at a given temperature difference between the casing and the shroud segments.

17. A method for attaching turbine shroud segments to a turbine casing, comprising:

retaining the shroud segments in the casing in a movable manner;

providing a clearance between each shroud segment and at least one of the casing and an adjacent shroud segment;

eliminating the clearance by thermal expansion of the shroud segment such that a portion of the shroud segment is fixably clamped with respect to at least one of the casing and an adjacent shroud segment such that further thermal expansion of the shroud segment moves a portion of the shroud segment positioned adjacent a turbine blade path radially outward, wherein an axial clearance between each shroud segment and the casing is provided and upon eliminating the axial clearance between each shroud segment and the casing, a portion of each shroud segment is clamped with respect to the casing.

18. A method as in claim 17, wherein the clearance is a circumferential clearance positioned between adjacent shroud segments.

19. A method as in claim 18, and further comprising retaining the shroud segments on the casing with elastically deformable locating elements that can resist radially outward movement of the portions of the shroud segments adjacent the turbine blade path, wherein, upon eliminating the circumferential clearances between all of the shroud segments, the shroud segments are clamped together as a ring and maintained as a ring by the resistance provided by the elastically deformable locating elements.

20. A method as in claim 19, wherein a width of a radial gap between each shroud segment and the turbine blade path is set by adjusting at least one of the clearance and an elasticity of the elastically deformable elements.

21. A method as in claim 19, wherein the clearance is reduced to zero at a given temperature difference between the casing and the shroud segments.

22. A method as in claim 17, wherein a width of a radial gap between each shroud segment and the turbine blade path is set by at least one of adjusting at least one of the clearances and adjusting an elasticity of the elastically deformable elements.

23. A method as in claim 17, wherein the clearance is an axial clearance between each shroud segment and the casing and upon eliminating the axial clearance between each shroud segment and the casing, a portion of each shroud segment is clamped with respect to the casing such that further thermal expansion of each shroud segment is directed radially outward.

24. A method as in claim 23, wherein a width of a radial gap between each shroud segment and the turbine blade path is set by adjusting the axial clearances.

25. A method as in claim 24, wherein the clearance is reduced to zero at a given temperature difference between the casing and the shroud segments.

26. A method as in claim 17, wherein the clearance is reduced to zero at a given temperature difference between the casing and the shroud segments.

* * * * *